US010152878B2

(12) United States Patent
Eichler

(10) Patent No.: US 10,152,878 B2
(45) Date of Patent: Dec. 11, 2018

(54) HAZARD DETECTOR, TEST DEVICE FOR HAZARD DETECTOR, HAZARD MONITORING SYSTEM AND METHOD FOR TESTING A HAZARD DETECTOR

(71) Applicant: Novar GmbH, Neuss (DE)

(72) Inventor: Stephan Eichler, Hilden (DE)

(73) Assignee: NOVAR GMBH, Neuss (DE)

( * ) Notice: Subject to any disclaimer, the term of this patent is extended or adjusted under 35 U.S.C. 154(b) by 0 days.

(21) Appl. No.: 15/689,802

(22) Filed: Aug. 29, 2017

(65) Prior Publication Data

US 2018/0061217 A1 Mar. 1, 2018

(30) Foreign Application Priority Data

Aug. 29, 2016 (EP) ..... 16186081

(51) Int. Cl.
*G08B 29/14* (2006.01)
*G08B 29/12* (2006.01)

(52) U.S. Cl.
CPC ..... *G08B 29/145* (2013.01); *G08B 29/123* (2013.01); *G08B 29/14* (2013.01)

(58) Field of Classification Search
CPC combination set(s) only.
See application file for complete search history.

(56) References Cited

U.S. PATENT DOCUMENTS 5,594,410 A * 1/1997 Lucas ..... G08B 7/062 340/328
8,810,387 B2 * 8/2014 Hall ..... G08B 29/12 340/291
2004/0217857 A1 11/2004 Lennartz et al.
2008/0084291 A1 * 4/2008 Campion ..... G08B 29/123 340/514
2008/0224847 A1 * 9/2008 Pepper ..... G08B 29/145 340/514

(Continued)

FOREIGN PATENT DOCUMENTS

EP 1 184 826 A2 3/2002
EP 1 398 746 A1 3/2004
WO WO 03/067542 A1 8/2003

(Continued)

OTHER PUBLICATIONS

Extended European Search Report, dated Feb. 22, 2017, corresponding to European Patent Application No. 16186081.2.

*Primary Examiner* — Travis R Hunnings
(74) *Attorney, Agent, or Firm* — Husch Blackwell LLP

(57) ABSTRACT

The invention provides a method for testing a hazard detector that includes transmitting a test mode switching signal from a test device to the hazard detector, setting the hazard detector to a test mode, transmitting a first test mode confirmation signal from the hazard detector to a central monitoring unit, transmitting a second test mode confirmation signal from the hazard detector to the test device, processing a hazard condition detected by the hazard detector as a test event, transmitting a test result signal from the hazard detector to the central monitoring unit, the hazard detector outputting a test completion signal, and setting the hazard detector to a detection mode. The invention further provides a hazard monitoring system, a hazard detector, and a test device.

5 Claims, 4 Drawing Sheets

(56) References Cited

U.S. PATENT DOCUMENTS

2010/0315224 A1* 12/2010 Orsini ..... G08B 29/126
340/516
2018/0012482 A1* 1/2018 Brown ..... G05B 19/0426

FOREIGN PATENT DOCUMENTS

WO WO 2009/087169 A1 7/2009
WO WO 2012/045998 A2 4/2012

* cited by examiner

HAZARD DETECTOR, TEST DEVICE FOR HAZARD DETECTOR, HAZARD MONITORING SYSTEM AND METHOD FOR TESTING A HAZARD DETECTOR

FIELD

The present invention is directed to a hazard detector, a test device for a hazard detector, a hazard monitoring system and a method for testing a hazard detector.

BACKGROUND

WO 2009 087169 A1 discloses a hazard monitoring system comprising a central monitoring unit and a plurality of hazard detectors connected with the central monitoring unit by means of a bus system. Preferably, a part of the detectors are smoke detectors.

Both, upon installation and at regular intervals during the operation of such a hazard monitoring system, it is essential to test the individual hazard detectors so as to ensure reliable operation of the hazard monitoring system.

For example, fire alarm systems are regulated by standards (such as EN54). According to some of these standards a smoke detector has to be maintained once a year. Customers prefer to install systems that can be maintained cost-effectively. A large and regularly accruing share of the costs is caused by a so called Walk-Test, a maintenance job required by some of the standards.

The following describes the actual workflow of such a Walk-Test. Right now installers require two technicians to maintain a system. They start the Walk-Test for a group of detectors. At first one of the technicians moves to the first of those detectors, simulates a fire with a fire detector test device and informs the other technician, who is still in front of a fire alarm control panel of a central monitoring unit. He waits for the information from the first technician that the test is running now. When the second technician gets informed by the first technician, he documents whether the fire alarm control panel shows the fire. If so, he prompts the first technician to go to the next detector. If not he prompts the first technician to test the detector again or to exchange it. During that time the second technician waits again. By the way, the first and the second technicians communicate by mobile phone. When all detector tests are done, the second technician stops the Walk-Test at the fire alarm control panel and a protocol must be created manually.

WO 2003 067542 A1 discloses a test device and a testing method for a hazard detector. According to this document a test device is located at the end of a pool and placed adjacent to a hazard detector to read and write to an electronic device of the hazard detector through a wireless communication link. The test device causes the hazard detector to carry out a predetermined operation and the result of the operation together with the identity of the detector is read by the test device from the electronic device using the wireless communication link. The corresponding test result and the identity of the detector are stored in the test device.

With this test device it is possible for a single person to test the hazard detectors. However, the hazard detectors are not tested regarding the communication with a central fire alarm control panel. Furthermore, it is difficult to control whether all detectors have been tested. Finally, during the test the whole system, including all hazard detectors connected to a central fire alarm control panel have to be put into a test mode in order to avoid an erroneous alarm of the entire system.

BRIEF SUMMARY

It is an object of the present invention to provide an improved hazard detector, a test device for a hazard detector, a hazard monitoring system and a method for testing a hazard detector, which allow to overcome the above drawbacks.

According to the present invention the above object is achieved by a hazard detector configured to be connected with a central monitoring unit. The hazard detector comprises a detection means for detecting a hazard condition, a first communication means for communicating with the central monitoring unit, a second communication means for communicating with a test device.

According to the invention the second communication means is a bi-directional communication means allowing receiving and transmitting of signals from and to the test device.

The hazard detector is configured to receive a test mode switching signal from the test device, transmit an ID-information and a first test mode confirmation signal to the central monitoring unit, transmit a second test mode confirmation signal to the test device, transmit a detection result signal to the central monitoring unit, and transmit a test completion signal to the test device.

The hazard detector according to the invention is configured such that the test completion signal comprises ID-information allowing to identify the hazard detector and information indicating the success or failure of the test.

Furthermore, the invention provides a test device for a hazard detector comprising testing means for applying a test condition to the hazard detector, third communication means for allowing a bi-directional communication with the hazard detector, wherein the third communication means is configured to transmit a test mode switching signal to the hazard detector, receive a second test mode confirmation signal from the hazard detector and receive a test completion signal from the hazard detector. Preferably the test device comprises a memory for storing a second log file containing ID information of a tested hazard detector and information indicating a success or failure of the test.

The test device according to the invention is configured such that the test completion signal comprises the ID-information of the tested hazard detector and information indicating the success or the failure of the test.

According to the invention there is provided a hazard monitoring system comprising a central monitoring unit, a plurality of hazard detectors, and a test device, wherein the central monitoring unit is configured to mark a hazard detector as being in a test mode upon receiving a first test mode confirmation signal and to mark the hazard detector as being in a detection mode after processing the next detection event as a test event or after the lapse of a predetermined time.

The hazard monitoring system according to the invention is configured such that the central monitoring unit comprises fourth communication means for a bi-directional communication with the test device, and the third communication means is further configured to transmit the second log file stored in the test device to the central monitoring unit.

The above hazard monitoring system is further configured such that the central monitoring unit correlates the received test completion signal with test result signal previously received from the at least one hazard detector and stored in a first log file together with ID information of the tested hazard detector, and the central monitoring unit outputs a test result protocol displaying all hazard detectors and test results for all hazard detectors tested.

Additionally the invention provides a method for testing a hazard detector comprising the steps of transmitting from a test device a test mode switching signal to the hazard detector, setting the hazard detector to a test mode, transmitting from the hazard detector a first test mode confirmation signal to a central monitoring unit, transmitting from the hazard detector a second test mode confirmation signal to the test device, processing a subsequent hazard condition detected by the detection means of the hazard detector as a test, transmitting from the hazard detector a test result signal to the central monitoring unit, transmitting from the hazard detector (13) a test completion signal to the test device, and setting the hazard detector to a detection mode.

In the above method the test completion signal can comprise information allowing to identify the hazard detector and information indicating the success or failure of the test.

The above method can further comprise storing by the test device the test completion signal of at least one tested hazard detector in a second log file, storing by the central monitoring unit the ID information and the test result signal of any tested hazard detector in a first log file, transmitting from the test device the second log file to the central monitoring unit, correlating by the central monitoring unit the received second log file with the first log file, and outputting by the central monitoring unit a test result protocol displaying all hazard detectors and test results for all hazard detectors tested.

DETAILED DESCRIPTION

Figure 1:
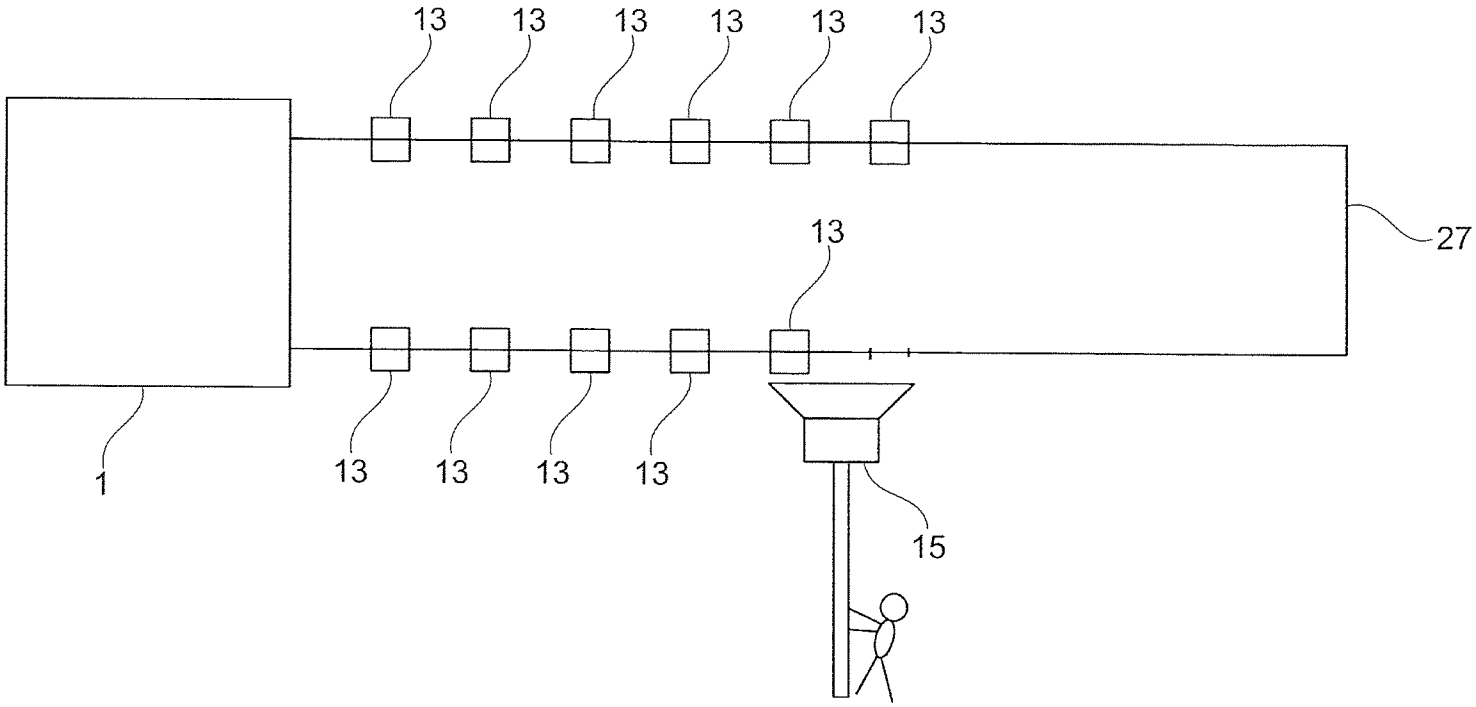
FIG. 1 illustrates the hazard monitoring system according to the invention.

While this invention is susceptible of an embodiment in many different forms, there are shown in the drawings and will be described herein in detail specific embodiments thereof with the understanding that the present disclosure is to be considered as an exemplification of the principles of the invention. It is not intended to limit the invention to the specific illustrated embodiments.

FIG. 1 shows a hazard monitoring system according to the invention. The system comprises a central monitoring unit 1, which is connected with a bus 27. The bus 27 is provided so as to connect a plurality of hazard detectors 13. The hazard detectors 13 are preferably heat detectors or smoke detectors. However, the hazard detectors 13 are not limited to these examples. Other hazard detectors 13 like gas detectors, radiation detectors or pollution detectors can be used instead. The invention is also applicable for burglar alarm systems with intrusion detectors.

In the preferred embodiment the system is configured so that the central monitoring unit 1 can address individually each of the hazard detectors 13 connected along the bus 27. Furthermore, the bus 27 is preferably formed as a loop. However, other configurations, as stitch lines are possible as well.

In a preferred embodiment the bus 27 is formed as a combined bus, providing both, energy and signals, to the hazard detectors 13. However it is of course possible to provide separate buses for the energy supply and for the communication. It goes without saying that instead of the wired bus a wireless connection or a partial wireless connection between the hazard detectors 13 and the central monitoring unit can be implemented.

A typical example for the invention is a fire alarm system comprising a plurality of smoke detectors. According to the present standards—like EN54—a smoke detector has to be maintained once a year. In order to perform the maintenance a so called Walk-Test is implemented. FIG. 1 shows a technician carrying a test device 11, which is configured to simulate a fire, for example by applying smoke or heat to one of the hazard detectors 13.

Figure 2:
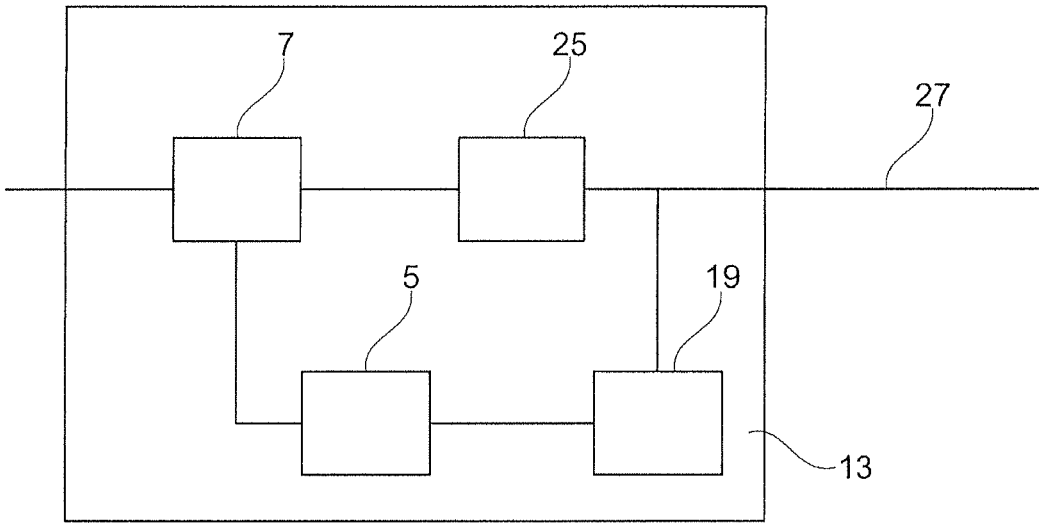
FIG. 2 illustrates the hazard detector according to the invention.

FIG. 2 shows in more detail the configuration of a hazard detector according to the invention. The hazard detector 13 of FIG. 2 comprises a first communication means 7 connected to enable a communication through the bus 27 with the central monitoring unit 1. This first communication means 7 is primarily intended to transmit alarm signals from the hazard detector 13 to the central monitoring unit 1. The first communication means 7 is preferably designed for a bi-directional communication. For example, the central monitoring unit 1 might transmit setting parameters to the hazard detector 13 and receive ID-information and alarm signals from the hazard detector 13.

The hazard detector 13 further comprises a detection means 5 for detecting a hazard condition, for example smoke, heat, gas, radiation or any other kind of hazard. The detection means 5 is connected with the first communication means 7.

Additionally, the hazard detector 13 is provided with the second communication means 9. The second communication means 9 is configured for a bi-directional communication so as to allow receiving and transmitting signals to the test device 11.

As usual, the hazard detector 13 is equipped with the central processing unit 25 controlling the first and second communication means 7, 9 as well as the detection means 5.

Preferably the second communication means 9 makes use of a short range wireless communication, either using a radiofrequency transmission system or an optical transmission system. As an alternative the hazard detector 13 might be provided with the plug for a connection with a female connector provided with the test device 11, so as to establish a wire based communication between the second communication means 9 and the test device 11.

The hazard detector 13 has two operation modes, i.e. a test mode and a detection mode or normal operation mode. The hazard detector 13 is configured so as to allow to be set in one of these operation modes.

In the detection mode in case of a detection event indicated by the detection means 5 the first communication means 7 under the control of the central processing unit 25 will transmit an alarm signal through the bus 27 to the central monitoring unit 1 and the central monitoring unit 1 will process the alarm signal as a real alarm event.

In the test mode in case of a detection event, i.e. test event, indicated by the detection means 5, under the control of the central processing unit 25 the first communication means 7 will transmit a signal encoding the test result signal to the central monitoring unit 1 and the central monitoring unit 1 will process the test result signal as a test event. It should be noted that the content and form of the alarm signal and the test result signal might be identical, if the setting of the test mode is done by marking the respective hazard detector 13 in the monitoring central unit 1.

Furthermore, the first communication means 7 of the hazard detector 13 under the control of the central processing unit 25 will transmit a signal, i.e. a first test mode confirmation signal, indicating the switching between the detection mode and the test mode to the central monitoring unit 1.

The second communication means 9 is configured to receive a test mode switching signal from the test device 11. Upon reception of them test mode switching signal by the second communication means 9, the central processing unit 25 of the hazard detector 13 will set the hazard detector 13 into the test mode. As indicated above the setting of the test mode can be done by marking the respective hazard detector 13 in the central monitoring unit 1 as being in a test mode. The second communication means subsequently transmits a second test mode confirmation signal to the test device 11.

The first and second test mode confirmation signals differ in so far as that the first test mode confirmation signal is transmitted via the first communication means 7 and the bus 27 to the central monitoring unit 1, whereas the second test mode confirmation signal is transmitted via the second communication means 9 to the test device 11.

Either after the lapse of a certain time or after receiving a corresponding instruction or after the processing of a detection event by the central processing unit 25 of the hazard detector 13, the central processing unit 25 of the hazard detector 13 will set the hazard detector 13 back from the test mode to the detection mode and will instruct the first and/or second communication means 7, 9 to transmit a corresponding detection mode confirmation signal to the central monitoring unit 1 and a test completion signal to the test device 11, respectively.

Figure 3:
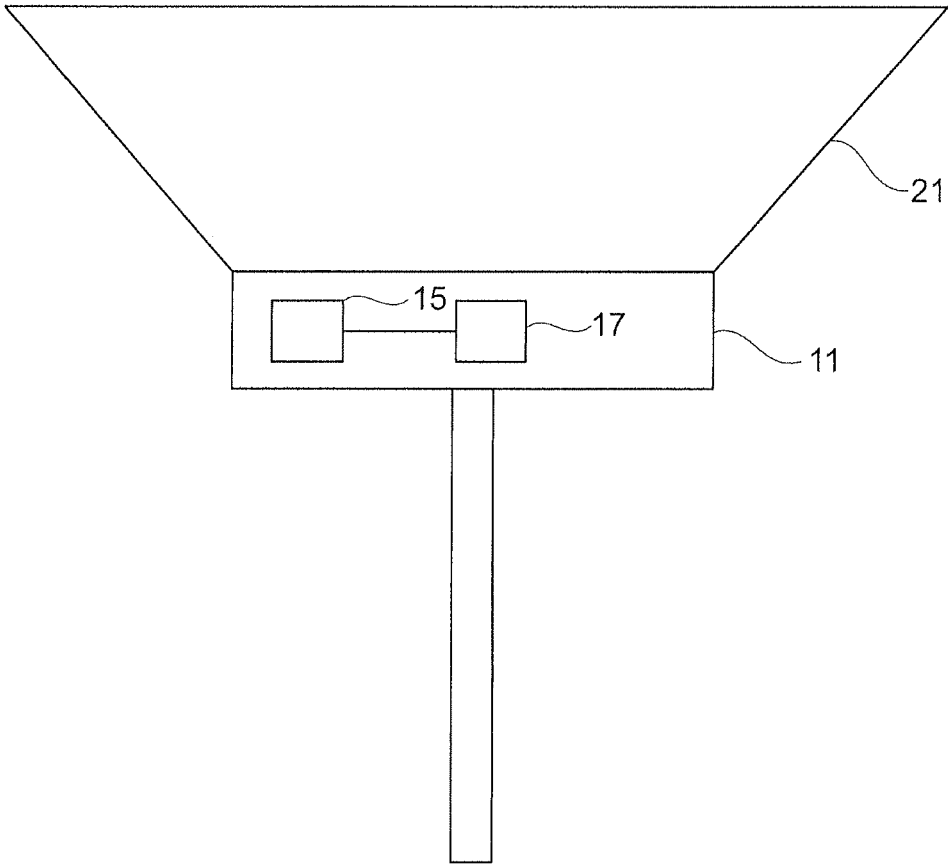
FIG. 3 illustrates the testing device according to the invention.

FIG. 3 illustrates in more detail the test device 11 according to the present invention. The test device 11 comprises the third communication means 17 configured to allow a communication of signals with any one of the second communication means 9 provided with the hazard detector 13.

As indicated above, the communication between the second communication means 9 and the third communication means 17 is implemented by a short range wireless communication, for example near-field communication, Bluetooth or an optical communication. As an alternative a wire based communication using the plug-and-socket system can be used instead.

The test device 11 additionally comprises a testing means 15 for applying a test condition to the hazard detector 13. The testing means 15 can be a smoke source, a heat source, a radiation source, just to mention a few examples. The testing means 15 has to be able to generate an environment simulating a real detection event of the detecting means 5 of the hazard detector 13.

Preferably, the test device 11 is provided with a pole so as to allow the technician to hold the test device 11 adjacent to the hazard detector 13, which usually is located at the ceiling of a surveillance area. The test device 11 is preferably configured so as to have a cup-like portion designed so as to surround and enclose a hazard detector 13.

Preferably the test device 11 is configured so as to transmit a test mode switching signal via the third communication means 17 to the second communication means 9 of the hazard detector 13 based on an instruction of the technician. As an alternative, an automatic switching means might be provided, so that the test device 11 automatically transmits the test mode switching signal when the presence of a hazard detector 13 is recognized, either mechanically—i.e. by pressing the test device against the ceiling—optically—i.e. by means of a bar code reader reading a bar code of the hazard detector housing—or via data exchange—i.e. exchange of identification signals between the hazard detector 13 and the test device 11.

The operation of a hazard monitoring system according to the present invention will now be explained based on FIG. 4.

Figure 4:
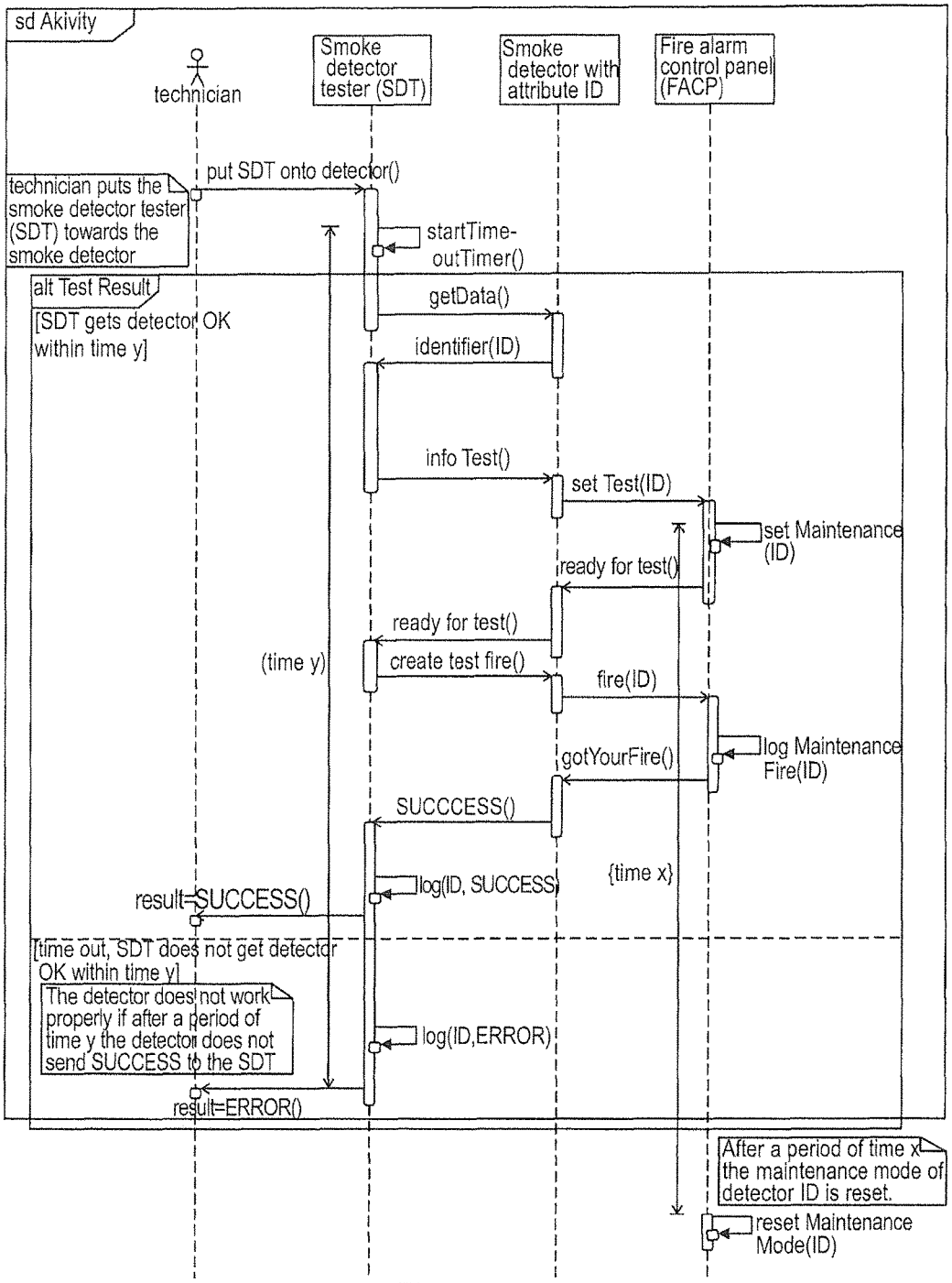
FIG. 4 illustrates a flow chart explaining the testing method of the invention.

FIG. 4 shows a flow diagram explaining the individual steps of a preferred test method carried out in the hazard monitoring system.

During the Walk-Test the technician brings the test device 11 into contact/interaction with the hazard detector 13. This can be done for example by pressing the cup-like portion of the test device 11 against the ceiling so as to surround a hazard detector 13, mounted at the ceiling.

The third communication means 17 of the test device 11 and the second communication means 9 of the hazard detector 13 will start to communicate with each other.

In the embodiment of FIG. 4 the test device 11 and the hazard detector 13 will exchange ID-information of the hazard detector 13, which will be stored in a second log file in a memory of the test device 11.

Subsequently the test device 11 will transmit a test mode switching signal to the hazard detector 13.

As shown in FIG. 4 additionally the hazard detector 13 will transmit a first test mode confirmation signal, including his ID-information and a test setting commend, to the central monitoring unit 1. The central monitoring unit 1 will acknowledge receipt of the first test mode confirmation signal by sending a message to the hazard detector 13 indicating that the central monitoring unit 1 is now ready for a test event of this hazard detector 13.

The hazard detector 13 will transmit a second test mode confirmation signal back to the test device 11.

Subsequently, the test device 11 will start to apply a test condition to the hazard detector 13, for example by emitting smoke or heat, in other words, by creating a test fire.

If the detection means 5 of the hazard detector 13 succeeds in detecting the hazard condition, the hazard detector 13 will proceed to transmit a signal indicating "fire" together with its ID-information to the central monitoring unit 1.

The central monitoring unit 1 will acknowledge the receipt of the fire signal. Additionally, the central monitoring unit 1 stores the fire event together with the ID-information of the hazard detector 13 and the test condition of this hazard detector 13 in a first log file.

The hazard detector 13 will send a test completion signal back to the test device 11, if the detection means 5 has detected the hazard condition. In this case the test of the respective hazard detector 13 will be considered as successful and this will be recorded together with the ID of the hazard detector 13 in the second log file.

If no such test completion signal is received by the test device 11 within a predetermined time, the test of the respective hazard detector 13 will be considered as failed and this will be recorded together with the ID-information of the hazard detector 13 in the second log file.

In any case the technician will be informed about the end of the test, e.g. by an acoustic signal, by an optical signal, a vibration or a combination of any of these.

Subsequently, the technician can move to the next hazard detector 13 and perform the next test.

At the end of the Walk-Test, that is after having tested all of the hazard detectors 13, the technician can move to the central monitoring unit 1 and check the first and second log files.

If the first log file shows that all of the hazard detectors 13 of the system have been tested successfully, the Walk-Test is completed.

If the first log file shows that one or more of the hazard detectors 13 have not reported a test condition and/or a fire event, the operator will check the second log file stored in the testing device 11, in order to verify that the corresponding hazard detector 13 has actually been included in the Walk-Test.

If the respective hazard detector 13 has been included in the Walk-Test and if the second log file shows that the test has been performed successfully, then it is concluded that the communication between the respective hazard detector 13 and the central monitoring unit 1 has failed.

If the respective hazard detector 13 is not included in the Walk-Test, the technician will restart the Walk-Test and move to the respective hazard detector 13 in order to complete the test.

In other words, the Walk-Test will comprise the following steps.

When the test device 11 is put onto the hazard detector 13, the test device 11 communicates with the hazard detector 13 and asks for his identifiers and informs that the following fire is a test.

The hazard detector 13 sends this information to the central monitoring unit 1.

The hazard detector 13 is set into a test or maintenance mode, or alternatively the central monitoring unit 1 marks the respective hazard detector 13 as being in a test mode.

The central monitoring unit 1 sends an acknowledgement/answers to the hazard detector 13 confirming the test mode setting.

The hazard detector 13 informs the test device 11, that it is "ready for testing" by transmitting the second test mode confirmation signal. The creation of the second test mode confirmation signal can be made dependent upon the reception of the acknowledgment from the central monitoring unit 1.

The test device 11 creates a test fire.

In the preferred embodiment the test device 11 creates the test fire automatically only if it receives "ready for test" information (step 5). Because only in this case the central monitoring unit 1 knows that the hazard detector 13 is tested.

When the hazard detector 13 recognizes the fire, it informs the central monitoring unit 1 by transmitting a detection result signal.

The central monitoring unit 1 logs the fire of the hazard detector 13 and informs the hazed detector 13, that his detection result signal was transmitted.

The hazard detector 13 informs the test device 11 that the fire was tested successfully.

The test device 11 logs that the hazard detector 13 was successfully tested and indicates SUCCESS by a corresponding signal.

In the event that the test device 11 does not receive the identifiers or the "ready for testing" message or the SUCCESS message from the detector within respective predetermined times, the test device 11 logs an error for that hazard detector 13 and signals ERROR.

In any case, a predetermined time after the hazard detector 13 went into the test mode, the hazard detector 13 will switch back to the detection mode, either under the control of an internal timer, based an instruction from the central monitoring unit 1 or based on the transmission of a test completion signal to the test device 11.

With the above configuration of the system. the Walk-Test can be done by only one technician. This leads to lower costs compared to the current approaches.

Only the presently tested hazard detector 13 is in the test mode. All other hazard detectors 13 can still raise a fire. This leads to a more safety system.

Of course it is possible to perform the Walk-Test by a plurality of technicians testing a plurality of hazard detectors 13 in parallel. In this case the respective second log files of the individual test devises 11 have to be combined before matching with the first log file of the central monitoring unit.

The report of the Walk-Test can be created automatically with the second log file of the test device 11 and/or the first log file of the central monitoring unit 1.

Although the present invention has been described based on a preferred embodiment, it is obvious for a skilled present, that various modifications might be implemented.

For example, in an alternative embodiment, the hazard detector 13 can be configured to transmit the test completion signal to the test device 11 only upon receiving the acknowledgment signal from the central monitoring unit 1. This will ensure that both, the detection means 5 and the communication with the central monitoring unit 1, operate correctly.

In the above preferred embodiment, two separate log files, that is the first log file and the second log file, are created and stored in the central monitoring unit 1 and the test device 11, respectively. However, it will be possible, to create only one of the lock files, either the first log file or the second log file. For example, if only the second log file in the test device 11 is created, the operator will at the end of the walk test compare the data in this second log file with system data showing the configuration of the hazard monitoring system, which might be provided either by an electronic file in an evaluation computer or as any other kind of documentation, for example as paper handbook.

On the other hand, if only the first log file is created, the communication between the test device 11 and the hazard detector 13 can be simplified, since in this case the test device 11 does not have to receive neither the ID information of the hazard detector 13 nor the test result. It will be enough that the test device 11 can transmit the test mode switching signal to the hazard detector 13 and receive a signal indicating that the test is completed. In this case, the signal indicating that the test is completed can be for example an acoustic signal output by the hazard detector 13 itself.

Furthermore, although not shown above, it might be possible to provide the central monitoring unit 1 with a fourth communication means 19 for a bi-directional communication with the test device 11, so as to allow to transfer the second log file, stored in the test device 11, to the central monitoring unit 1 in order to match the first and second log files and to assist the operator in the evaluation of the Walk-Test. In this embodiment the central monitoring unit 1 might be implemented with the display unit displaying a map of the hazard monitoring system marking those hazard detectors 13 which have been tested successfully in a first color, for example green, those hazard detectors 13, which have failed the test, in a second color, for example in red, and those other detectors 13, which have not been tested at all, in a third color, for example in yellow.

Although a few embodiments have been described in detail above, other modifications are possible. For example, the logic flows described above do not require the particular order described or sequential order to achieve desirable results. Other steps may be provided, steps may be eliminated from the described flows, and other components may be added to or removed from the described systems. Other embodiments may be within the scope of the invention.

From the foregoing, it will be observed that numerous variations and modifications may be effected without departing from the spirit and scope of the invention. It is to be understood that no limitation with respect to the specific system or method described herein is intended or should be inferred. It is, of course, intended to cover all such modifications as fall within the spirit and scope of the invention.

The invention claimed is:

1. A hazard detector comprising:

a detector for detecting a hazard condition;

a first communication device for communicating with a central monitoring unit; and a second communication device for communicating with a test device, wherein the second communication device is in bi-directional communication with the test device for receiving and transmitting communication signals from and to the test device, and wherein the hazard detector receives a test mode switching signal from the test device, transmits ID information and a first test mode confirmation signal to the central monitoring unit, transmits a second test mode confirmation signal to the test device, transmits a detection result signal to the central monitoring unit, and outputs a test completion signal.

2. The hazard detector according to claim 1, wherein the test completion signal includes the ID information to identify the hazard detector and test information to indicate success or failure of a test.

3. A method comprising:

transmitting a test mode switching signal from a test device to a hazard detector;

setting the hazard detector to a test mode;

transmitting a first test mode confirmation signal from the hazard detector to a central monitoring unit;

transmitting a second test mode confirmation signal from the hazard detector to the test device;

processing a hazard condition detected by the hazard detector as a test event;

transmitting a test result signal from the hazard detector to the central monitoring unit;

outputting a test completion signal from the hazard detector; and setting the hazard detector to a detection mode.

4. The method according to claim 3, wherein the test completion signal includes ID information to identify the hazard detector and test information indicating success or failure of the test event.

5. The method according to claim 4, further comprising:

the test device storing the ID information and the test completion signal of the hazard detector in a first log file;

the central monitoring unit storing the ID information and the test result signal from the hazard detector in a second log file;

transmitting the first log file from the test device to the central monitoring unit;

the central monitoring unit matching by the first log file with the second log file; and the central monitoring unit outputting a test result protocol displaying the hazard detector and test result information for the hazard detector.

* * * * *